US005186022A

United States Patent [19]

Kim

[11] Patent Number: 5,186,022

[45] Date of Patent: Feb. 16, 1993

[54] EVAPORATOR STRUCTURE FOR REFRIGERATOR-FREEZER

[75] Inventor: Man-Hoe Kim, Suwon, Rep. of Korea

[73] Assignee: Samsung Electronics Co., Ltd., Suwon, Rep. of Korea

[21] Appl. No.: 668,636

[22] Filed: Mar. 13, 1991

[30] Foreign Application Priority Data

Mar. 13, 1990 [KR] Rep. of Korea ..... 90-2891
May 16, 1990 [KR] Rep. of Korea ..... 90-6534
Jun. 27, 1990 [KR] Rep. of Korea ..... 90-9194

[51] Int. Cl.[5] ..... F25B 39/02

[52] U.S. Cl. ..... 62/515; 62/275; 165/64; 219/201

[58] Field of Search ..... 62/275, 276, 515; 165/64; 219/201

[56] References Cited

U.S. PATENT DOCUMENTS 3,362,183 1/1968 Sutton, Jr. ..... 62/276
3,783,635 1/1974 Perez ..... 165/64
4,369,350 1/1983 Kobayashi et al. ..... 62/276
4,492,851 1/1985 Carr ..... 62/276
4,756,358 7/1988 O'Neal ..... 62/275
4,766,736 8/1988 Waldschmidt ..... 62/275

FOREIGN PATENT DOCUMENTS 761282 1/1934 France .
1462089 12/1965 France .
6183890 4/1986 Japan .
855394 11/1960 United Kingdom .

*Primary Examiner*—Ronald C. Capossela
*Attorney, Agent, or Firm*—Burns, Doane, Swecker & Mathis

[57] ABSTRACT

An evaporator structure comprises a heating tube and a refrigerant tube. The heating tube contains a heating wire, and at least the refrigerant tube contains heat exchange fins. The tubes and fins are of one-piece extruded construction. The evaporator structure is bent to form straight sections interconnected by curved sections. Along the curved sections the tubes are spaced apart to define air-conducting paths. The fins may alternatively be formed in a plate which interconnects the tubes.

13 Claims, 9 Drawing Sheets

EVAPORATOR STRUCTURE FOR REFRIGERATOR-FREEZER

BACKGROUND OF THE INVENTION

1. Technical Field

The present invention relates to an evaporator structure for a refrigerator-freezer equipped with a defrosting heater, and more particularly to an evaporator structure for a refrigerator-freezer in which the refrigerant tube, heating tube and fins are integrally extruded of a good heat transferring material so that manufacturing process steps are decreased and at the same time cooling efficiency is improved.

2. Prior Art

According to the conventional evaporator structure, various structures have been known in view point that defrosting efficiency is improved so that cooling efficiency is also improved.

As a specific example of that, see the evaporator for a refrigerator-freezer described in Japanese Patent Official Publication Gazette No. Sho-62-39593 as shown in FIG. 1 herein. That apparatus comprises an refrigerant tube 11 bent in zigzag shape, small flat fins 12 inserted to a heater tube which is not shown, and a collar 13. The spacing between the small flat fins 12 is much that the opening at the air inflow side P is larger than air outflow side Q. At the same time the wattage of said heater tube is so made that the air inflow side P is of higher wattage and the air outflow side Q is of lower. There results the advantage that a loss of electric power is prevented. On the other hand, since the manufacturing process is relatively complicated and pitch intervals of the small flat fins 12 are different one another, there has been a worry about decreasing the defrosting efficiency.

If the defrosting efficiency is decreased, air the path is blocked, and therefore the may occur a problem that cooling efficiency is also decreased.

And in addition, a refrigeration system defrosting means is disclosed in U.S. Pat. No. 3,683,636 as shown herein in FIG. 2. In order to improve the defrosting function, a U-shaped defrosting heater 18 has upstanding parallel legs 17*a*, 17*b* spaced by a predetermined distance at symmetrical side positions of an evaporator 15. The legs 17*a*, 17*b* of the defrosting heater 18 are mounted longitudinally along the length of the evaporator whereby the defrosting heater is simplified and therefore there has been the advantage that the manufacturing cost is decreased. But, since the defrosting heater 18 surrounds the outer periphery of the evaporator, thermal efficiency is decreased, and therefore there has been a worry that defrosting efficiency is decreased.

As another example of conventional technique, an evaporator structure for refrigerator-freezer as shown herein in FIG. 3 is known, and hereinafter it will be briefly described with regard to the structure of said evaporator.

The evaporator structure 10 as shown in FIG. 3 has a refrigerant tube 20 and heating tube 30 (receiving an inserted heater wire 40) are integrally formed. The heating tubes 30 and the refrigerant tubes 20 are symmetrically formed at the top and bottom of a connecting plate. Then, almost the entire area of the plates is cut and pressed out in series to form a plurality of fins 50 spaced apart by predetermined even intervals and arranged in parallel toward one side direction so that air paths 60 are formed.

However, the above-described conventional evaporator structure for a refrigerator-freezer has been had a problem in that the manufacturing process is complicated, and when frost forms, air paths 60 are partially blocked, and the cooled air flow is not smooth so that cooling efficiency is decreased.

OBJECT AND SUMMARY OF THE PREFERRED EMBODIMENTS OF THE INVENTION

Therefore, the present invention is invented to solve such various problems, and it is an object of the present invention to provide an evaporator structure for a refrigerator-freezer in which manufacturing process steps are decreased, and settling distribution of frost is induced uniformly and at the same time defrosting efficiency is improved whereby the blocking of air paths is prevented so that cooling efficiency is improved.

In order to accomplish the above-described object, the evaporator structure for a refrigerator-freezer according to the present invention is characterized in that, an evaporator structure for refrigerator-freezer is provided with defrosting means, refrigerant tube, heating tube containing heater wire, and fins for increasing the surface area of the evaporator. The tubes and fins are of one-piece extruded construction and are bent to form curved sections which define air paths.

Further, the evaporator structure for a refrigerator-freezer according to the present invention is characterized in that, in an evaporator structure for refrigerator-freezer provided with defrosting means, heating tube containing a heater wire is arranged in one single row between two refrigerant tubes. Fins are integrally formed by extrusion and extend from opposite sides of said refrigerant tubes and heating tube. Also, air paths are formed for flowing cooled air through a bent portion.

Furthermore, the evaporator structure for refrigerator-freezer according to the present invention is characterized in that, in an evaporator structure for refrigerator-freezer provided with defrosting means, a single heating tube is fins which are bent alternately provided and connected with a refrigerant tube by a connecting plate. Fins at predetermined intervals toward different directions are integrally formed in the connecting plate.

BRIEF DESCRIPTION OF THE DRAWINGS

The above and other related objects and features of the invention will be apparent from a reading of the following description of the disclosure found in the accompanying drawings and the novelty thereof pointed out in the appended claims.

DETAILED DESCRIPTION OF THE PREFERRED EMBODIMENTS

Figure 1:
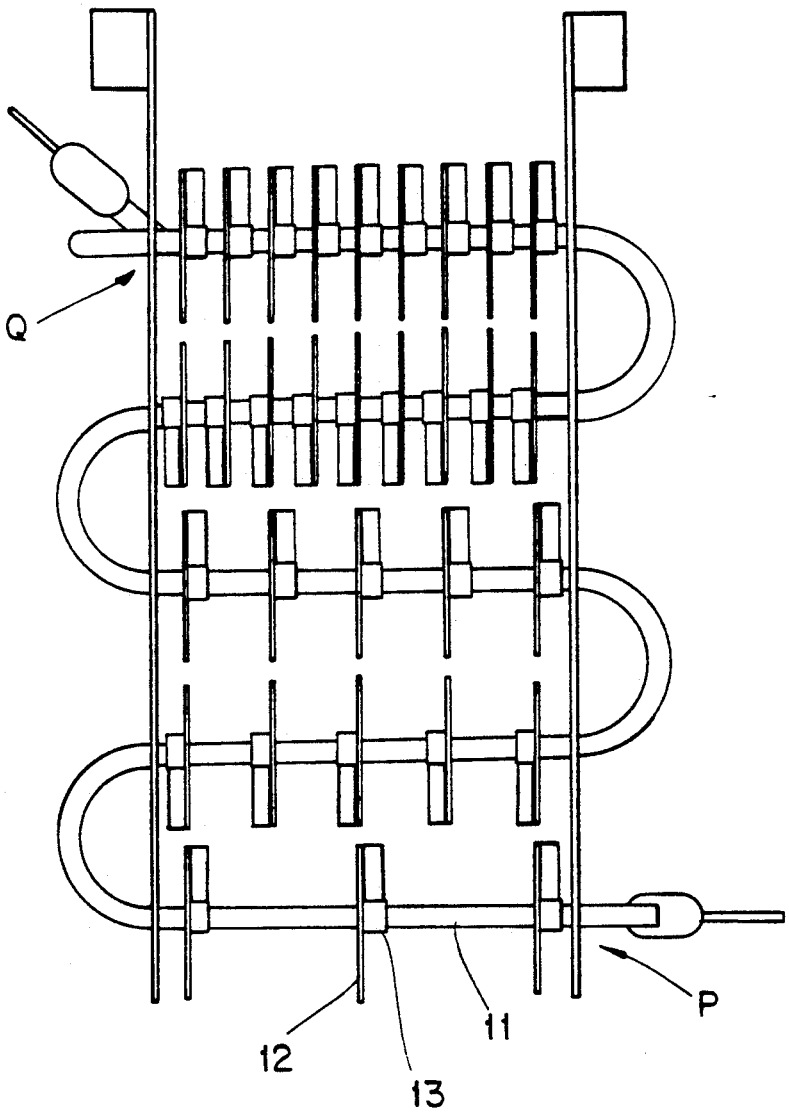
FIG. 1 (PRIOR ART)
FIG. 1 is a front elevational view of a conventional evaporator.
Figure 2:
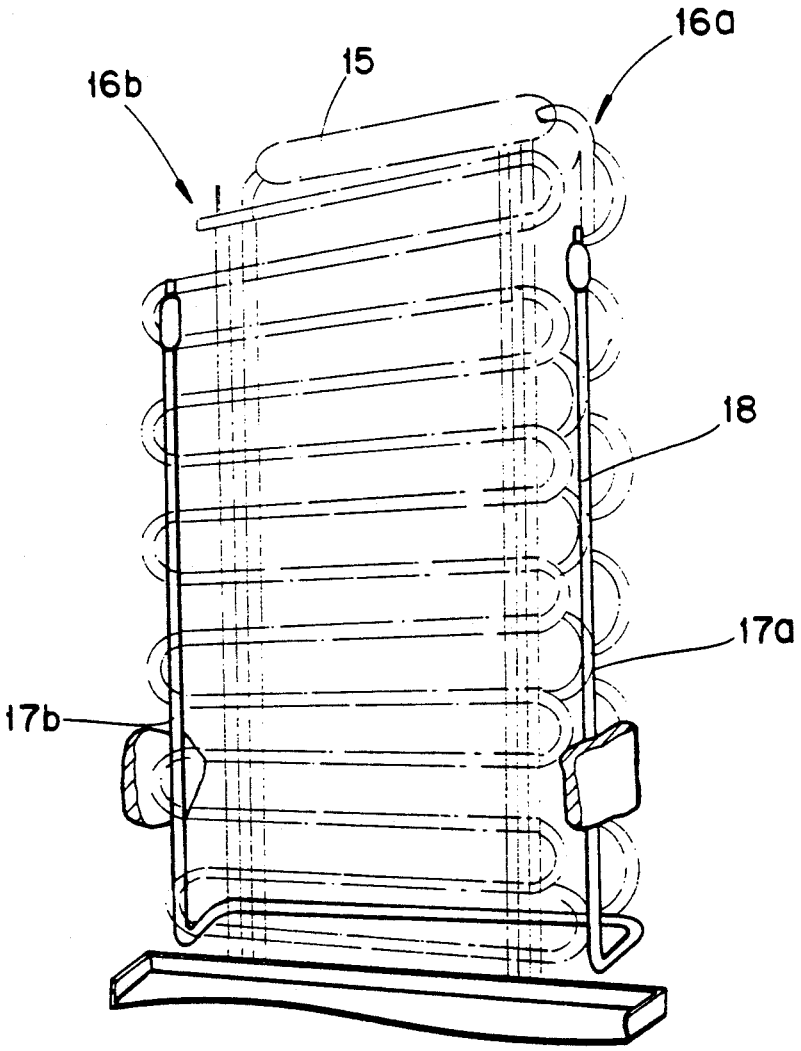
FIG. 2 (PRIOR ART)
FIG. 2 is a perspective view of another conventional evaporator.
Figure 3:
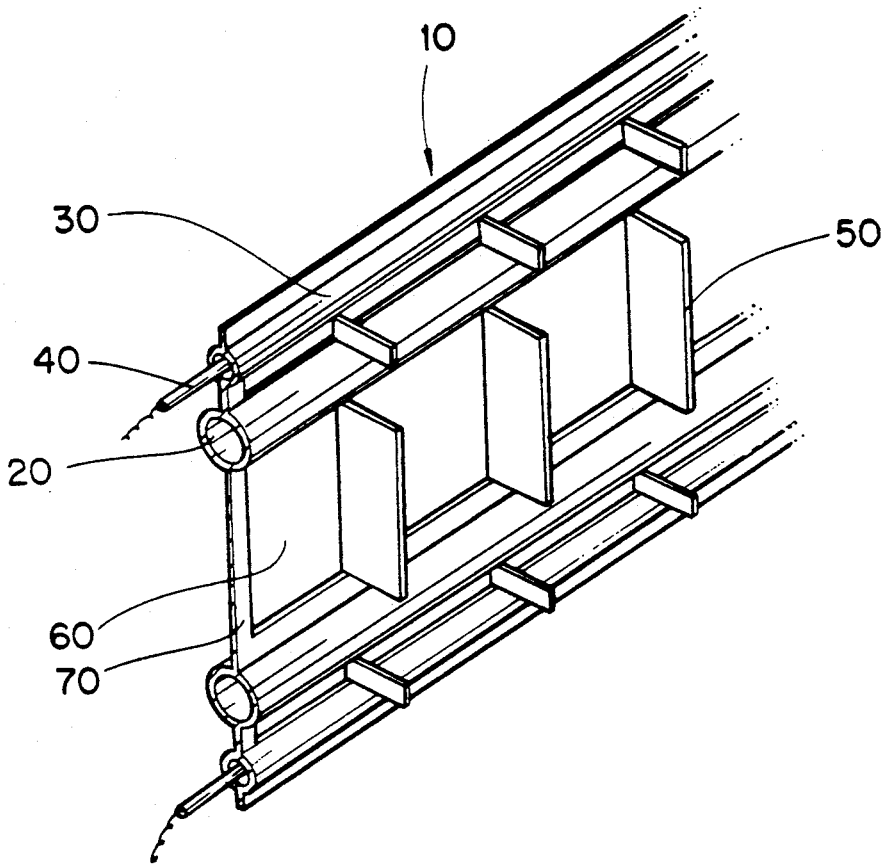
FIG. 3 (PRIOR ART)
FIG. 3 is a fragmentary perspective view of yet another conventional evaporator.
Figure 4:
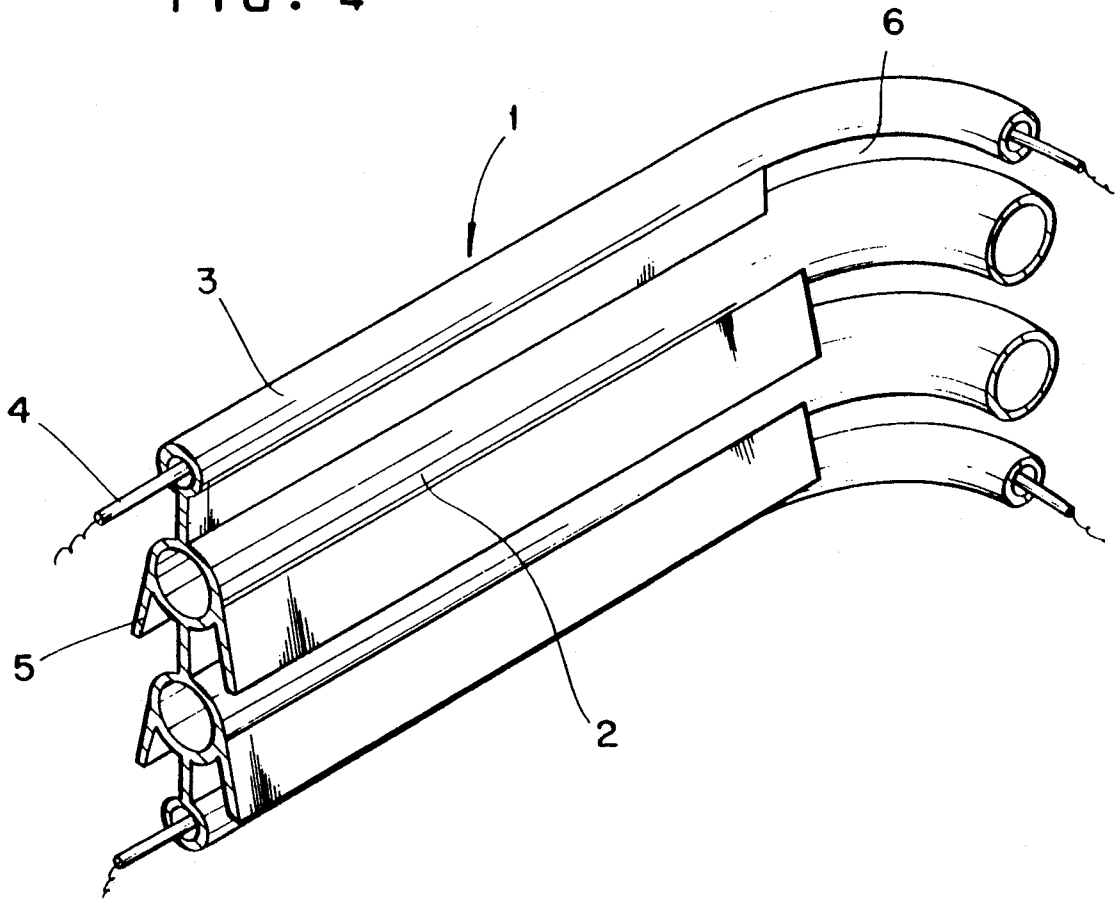
FIG. 4 is a fragmentary perspective view of an evaporator according to the present invention.
Figure 5:
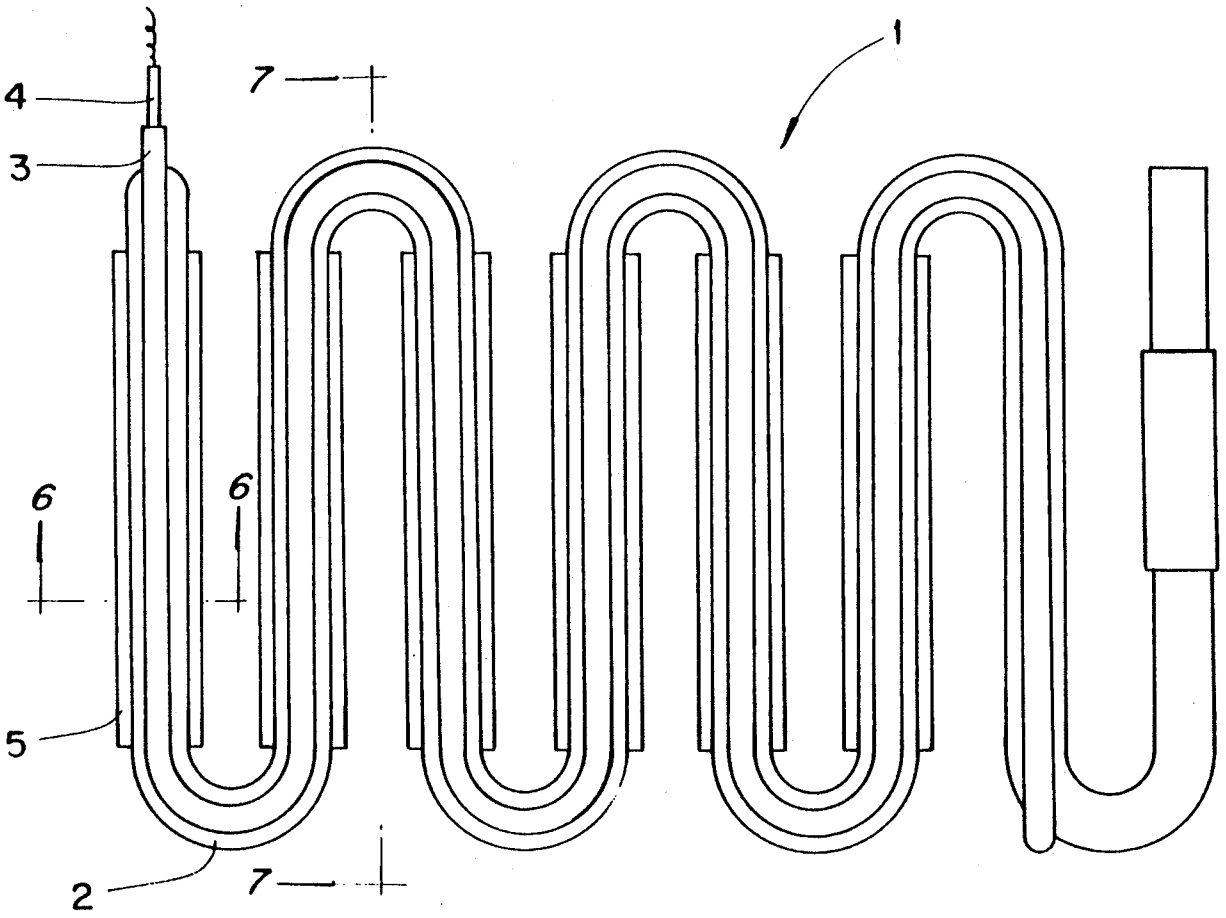
FIG. 5 is a schematic plan view of the entire evaporator depicted in FIG. 4.
Figure 7:
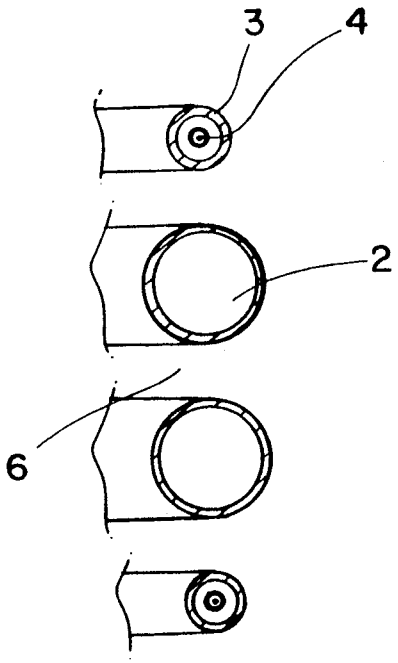
FIG. 7 is a cross sectional view taken along line 7—7 of FIG. 5.
Figure 6:
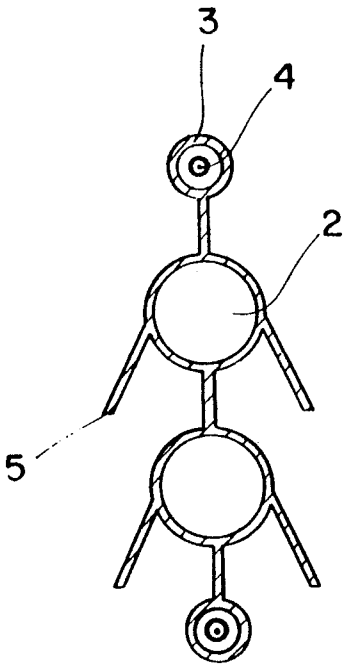
FIG. 6 is a cross sectional view taken along line 6—6 of FIG. 5.

Referring FIGS. 4 to 7, reference numeral 1 represents an evaporator, reference numeral 2 is a refrigerant tube which is made from a material good in thermal transferring rate such as aluminum A1 and conducting refrigerant gas and reference numeral 3 is a heating tube in which heater wire 4 applied with voltage by electric power supply source (not shown) and generating a heat is inserted and thereby said refrigerant gas is evaporated so that evaporator 1 is cooled and at the same time frost is removed.

Find 5 are formed at predetermined intervals such that the surface area of evaporator 1 is increased whereby defrosting efficiency and cooling efficiency are improved. Air paths 6 are formed at bent portions of evaporator 1 so that air (cooled air) flowing through the paths 6 exchanges heat with the evaporator's 1 surface which is cooled by normal cooling cycle.

Since the refrigerant tube 2, heating tube 3 inserted with heater wire 4, and fins 5 are integrally formed by extruding and also the air paths 6 to be passed with air are formed, and said fins 5 extend downward at right and left sides only at linear portions of the refrigerant tube 2, manufacturing of the evaporator is simple and easy. Since the width of the tube arrangement is designed whereby it is made to be integrally extruded, the pressure drop of cooled air is prevented and simultaneously the air flow side thermal transferring coefficient is increased. Since first settling distribution is uniformly induced, there is effect that capacity of evaporator is improved.

Figure 8:
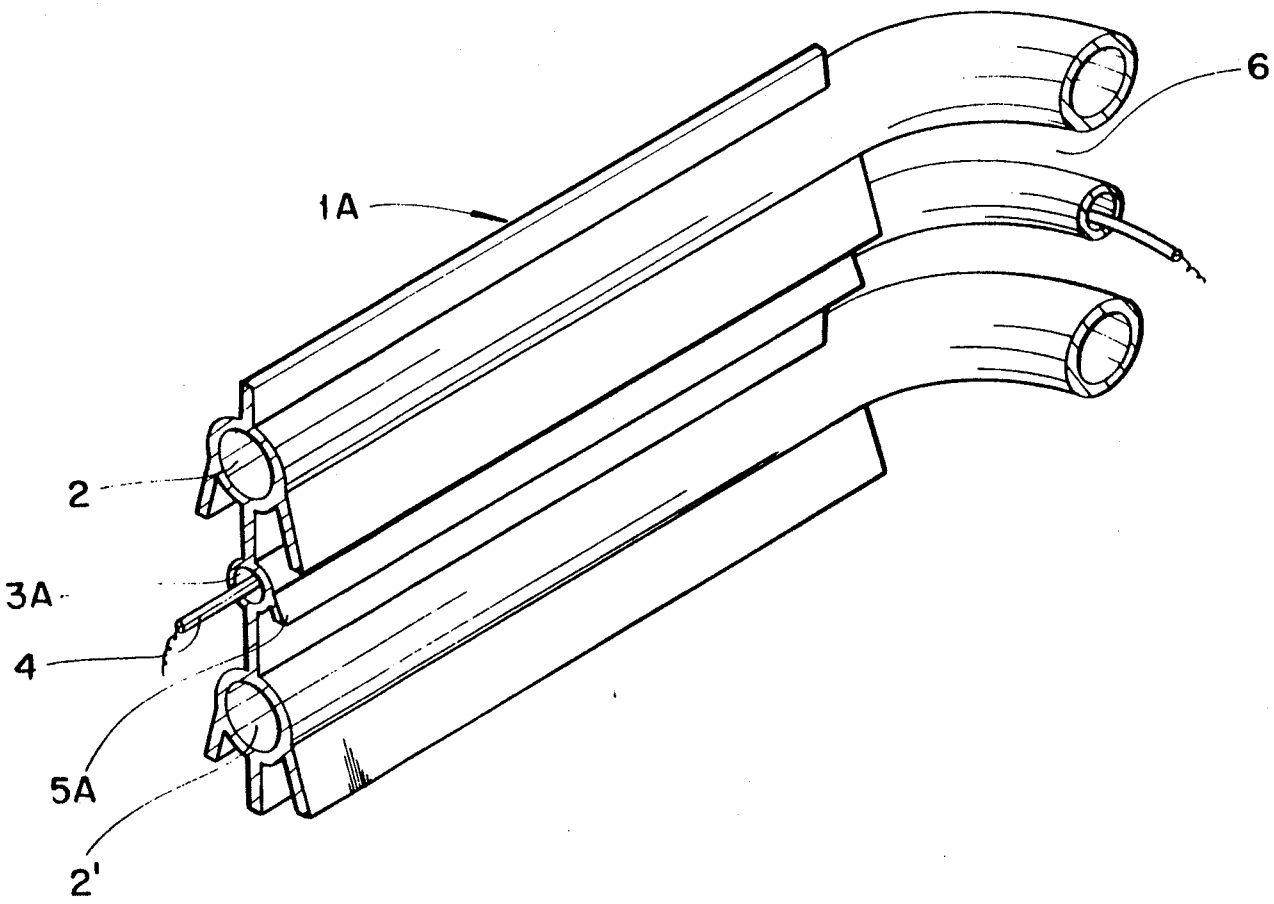
FIG. 8 is a fragmentary perspective view of a second embodiment of the present invention.

Next, the second embodiment of the present invention will be described in detail with reference to the FIGS. 8 and 9. The evaporators disclosed therein are also formed of one-piece by an extrusion step. The same reference numerals are given to the same parts or portions of the first embodiment.

In the second embodiment, a difference over the above-described first embodiment is that, in manufacturing an evaporator 1A provided with defrosting means for refrigerator-freezer, a heating tube 3 which receives a heater wire 4 for removing the frost is arranged in one single row between refrigerant tubes 2, 2' formed in two rows to be flowed with refrigerant gas. Fins 5 for increasing surface area of evaporator 1 are integrally formed by extrusion at right and sides of the refrigerant tubes 2, 2' and heating tube 3. Air paths 6 for conducting an air which is heat-exchanged with the surface of evaporator 1 cooled by a normal cooling cycle are formed at bent positions of the evaporator 1.

According to the evaporator structure in this second embodiment the manufacturing steps as well as the external magnitude of the entire evaporator can be decreased, and the width of the tube arrangement is designed whereby frost setting distribution is induced. The pressure drops of air passed through the evaporator is decreased and simultaneously the side thermal transferring coefficient is increased so that the heat transferring rate is increased, and therefore the capacity of the evaporator is improved.

Figure 9:
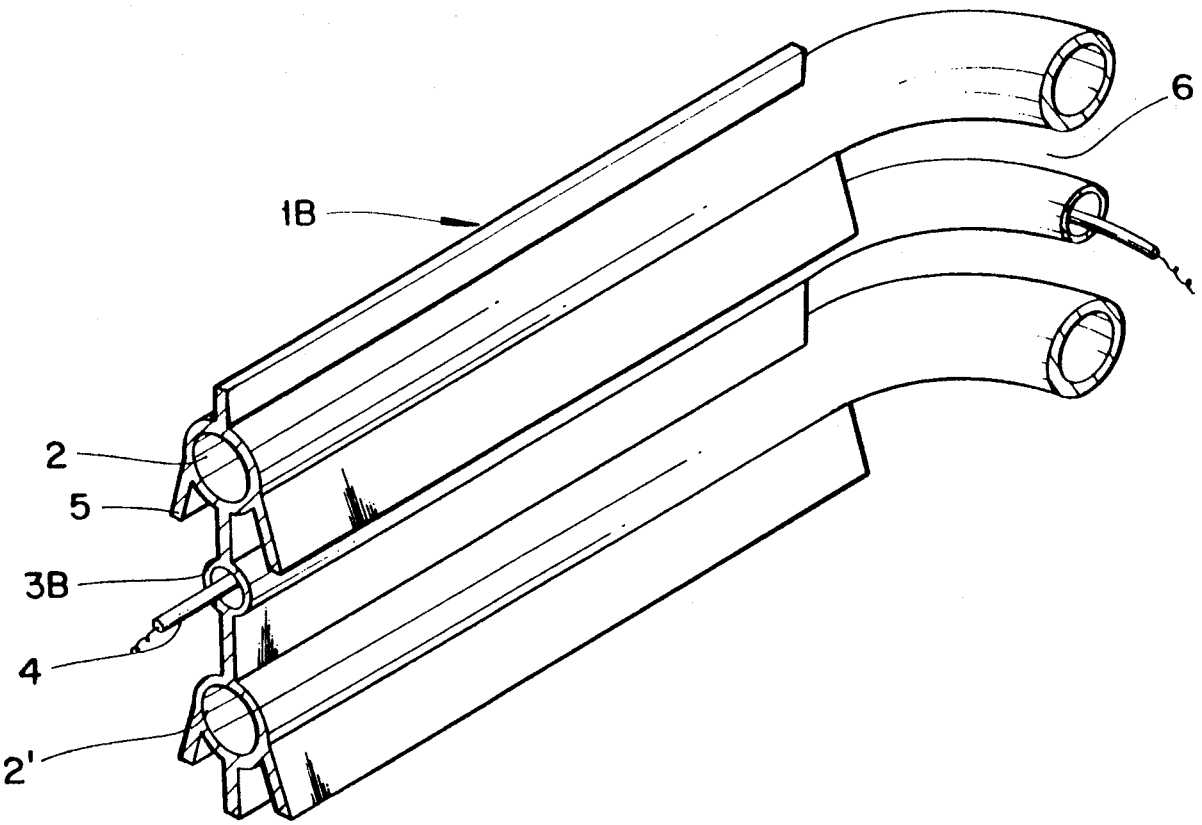
FIG. 9 is a fragmentary perspective view of a varied form of the second embodiment of FIG. 8.

And next, FIG. 9 shows a varied form of the second embodiment of the present invention, wherein the fins 5 are not formend at right and left sides of the heating tube 3B so as not to have contacting thermal resistance between the fins 5 and refrigerant tubes 2, 2'. Hence, the thermal isolation effect is increased.

Figure 10:
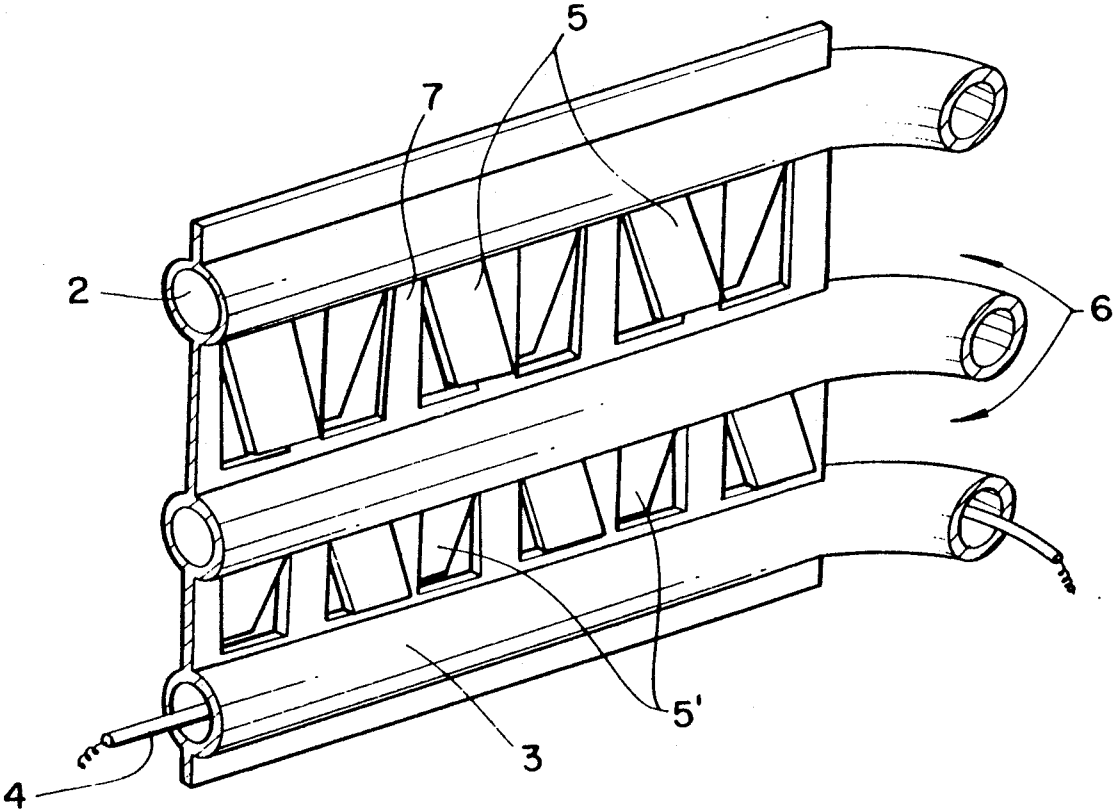
FIG. 10 is a fragmentary perspective view of a third embodiment of the present invention.

And next, the third embodiment of the present invention will be described in detail with reference to the FIG. 10.

The third embodiment of the present invention is different from said first and second embodiments in that, in manufacturing an evaporator, refrigerant tube (2) is arranged at an upper portion, and the heating tube 3 with heater wire 4 is arranged at a lower portion. Integrally formed fins 5, 5' are bent alternately in different directions and at evenly spaced intervals from a connecting plates 7 disposed between said refrigerant tube 2 and heating tube 3 so as to conduct air smoothly.

Since the fins 5, 5' are bent in different directions, the thermal transferring capacity is improved, and since frost settling distribution is uniformly induced, the blocking of air paths 6 upon the frost settling is prevented whereby cooled air flowing is carried out. Since the heating tube 3 is arranged in one single row at a lower portion, the thermal flowing speed per unit length is increased whereby the defrosting efficiency is improved and air paths 6 are formed at bent portions of the evaporator cooled air flowing is induced in parallel with the tubes so that cooling efficiency is improved.

The foregoing disclosure of specific embodiments is illustrative of the broad intensive concepts comprehended by the invention.

What is claimed:

1. An evaporator structure for a self-defrosting refrigerator-freezer, comprising a first tube for conducting refrigerant, a second tube disposed parallel with said first tube and containing an electrical heating wire, and heat exchanging fins extending outwardly from said first tube, said first and second tubes and said fins all being of one-piece construction, said structure being bent to form generally straight sections interconnected by curved sections, and open spaced being formed between said tubes at said curved sections to form air conducting paths.

2. An evaporator structure according to claim 1, wherein said first and second tubes are interconnected by webs along said straight sections but not along said curved sections.

3. An evaporator structure according t claim 1, wherein said fins extend substantially the entire length of said first tube within said straight sections.

4. An evaporator structure according to claim 3, wherein at least some of said fins extend obliquely relative to a plane containing said tubes.

5. An evaporator structure according to claim 3, wherein said fins extend from opposite sides of said first tube.

6. An evaporator structure according to claim 1, wherein said fins are discontinued along said curved sections.

7. An evaporator structure according to claim 1, wherein said second tube includes heat exchanger fins.

8. An evaporator tube according to claim 1, wherein said second tube contains no heat exchanger fins.

9. An evaporator structure according to claim 1, including a third tube for conducting refrigerant, said third tube disposed parallel to said first and second, said third tube containing heat exchanging fins and being of one-piece construction with said first and second tubes and said first-named fins.

10. An evaporator structure according to claim 9, wherein said second tube lies between said first and third tubes.

11. An evaporator according to claim 9 including a fourth tube extending parallel to said first, second, and third tubes and containing an electrical heating wire, said first and second tubes lying between said third and fourth tubes.

12. An evaporator structure for a self-defrosting refrigerator freezer, comprising a refrigerant tube for conducting a refrigerant; a heating tube extending parallel to and below said refrigerant tube for containing an electrical heating wire; a plate interconnecting said refrigerant tube and said heating tube; said plate including cut-out portions at a plurality of locations, said cut-out portions being bent alternately to opposite sides of said structure to form heat exchange fins, said heating tube, said refrigerant tube, and said plate being of one-piece construction.

13. An evaporator structure according to claim 12 including an additional refrigerant tube connected to one of said heating tube and said first-named refrigerant tube, and an additional plate interconnecting said additional refrigerant tube and said one of said heating tube and said first-named refrigerant tube, said additional plate including cut-out portions bent alternately to opposite sides of said structure to form heat exchange fins.

* * * * *